US005999158A

United States Patent [19]

Sekido et al.

[11] Patent Number: 5,999,158

[45] Date of Patent: Dec. 7, 1999

[54] DISPLAY DEVICE, DRIVE CIRCUIT FOR THE DISPLAY DEVICE, AND METHOD OF DRIVING THE DISPLAY DEVICE

[75] Inventors: Satoshi Sekido; Hirokazu Miwa; Mikio Oshiro; Takae Ito; Hiromi Enomoto, all of Kawasaki, Japan

[73] Assignee: Fujitsu Limited, Kawasaki, Japan

[21] Appl. No.: 08/710,374

[22] Filed: Sep. 16, 1996

[30] Foreign Application Priority Data

Apr. 10, 1996 [JP] Japan ..... 8-088148

[51] Int. Cl.[6] ..... G06G 3/36

[52] U.S. Cl. ..... 345/98

[58] Field of Search ..... 376/259; 340/721, 340/799; 395/135; 345/74, 174, 58, 89, 98

[56] References Cited

U.S. PATENT DOCUMENTS

| | | | |
|---|---|---|---|
| 4,868,557 | 9/1989 | Perlman | 340/799 |
| 4,902,469 | 2/1990 | Watson et al. | 376/259 |
| 5,091,720 | 2/1992 | Wood | 340/721 |
| 5,250,937 | 10/1993 | Kikuo et al. | 345/89 |
| 5,307,084 | 4/1994 | Yamaguchi et al. | 345/58 |
| 5,499,327 | 3/1996 | Satoh | 395/135 |
| 5,642,134 | 6/1997 | Ikeda | 345/174 |
| 5,663,742 | 9/1997 | Hush | 345/74 |

FOREIGN PATENT DOCUMENTS

| | | |
|---|---|---|
| 535220 | 2/1993 | Japan . |
| 7199873 | 8/1995 | Japan . |

*Primary Examiner*—Matthew Luu
*Assistant Examiner*—Jeff Piziali
*Attorney, Agent, or Firm*—Greer, Burns & Crain Ltd.

[57] ABSTRACT

A drive circuit for a display device including a display panel for displaying an image line by line has a data register. The data register is used to store optional data in response to a control signal, to overwrite the stored optional data with display data, and to prepare display data for a given line of the display panel. The data prepared in the data register is transferred to the display panel to display the given line of the display panel. The drive circuit is capable of supplementing display data if the display data is improper for the display, thereby securing the quality of the displayed images.

25 Claims, 14 Drawing Sheets

DISPLAY DEVICE, DRIVE CIRCUIT FOR THE DISPLAY DEVICE, AND METHOD OF DRIVING THE DISPLAY DEVICE

BACKGROUND OF THE INVENTION

1. Field of the Invention

The present invention relates to a display device, a drive circuit for the display device, and a method of driving the display device, and particularly, to a drive circuit of a liquid crystal display.

2. Description of the Related Art

Display devices are important for providing visual information. Liquid crystal displays are thin, low power consumption, and light, and therefore, are widely used for portable information equipment such as notebook-type personal computers and word processors. Semiconductor integrated circuits (ICs) for driving the liquid crystal displays must be simple and small.

The liquid crystal display (LCD) panel is driven by a dedicated integrated drive circuit. The drive circuit receives display data from a main device such as a personal computer and converts it into data voltages suitable for the panel.

By the way, if display data for a CRT is supplied as it is to the liquid crystal display, or if the number of pixels contained in display data does not fit that of the liquid crystal display, the displayed image will be disturbed. Therefore, the conventional display must have the dedicated display controller to convert input display data into that suitable for the display.

Note that the dedicated display controller increases the number of parts of the drive circuit, needs a large mounting space, consumes power, and deteriorates the versatility of the drive circuit. This problem occurs not only in the liquid crystal displays but also in other displays. Prior arts and their problems will be explained in detail with reference to drawings.

SUMMARY OF THE INVENTION

An object of the present invention is to provide a drive circuit, for a liquid crystal display, capable of supplementing display data if the display data is improper for the display, thereby securing the quality of the displayed images and the sound operation of liquid crystals. Another object of the present invention is to remove a dedicated display controller, which converts display data sent from a main device into proper data, from a liquid crystal display.

According to the present invention, there is provided a drive circuit, for a display device having a display panel for displaying an image line by line, comprising a data register for storing optional data in response to a control signal and overwriting the stored optional data with display data to prepare display data for a given line of the display panel, the data prepared in the data register being transferred to the display panel to display the given line on the display panel.

Further, according to the present invention, there is also provided a display device having a display panel for displaying an image line by line, a data driver for storing display data for each line of the display panel, and a gate driver for sequentially selecting one of the lines of the display panel, wherein the data driver comprises a data register for storing optional data in response to a control signal and overwriting the stored optional data with display data to prepare display data for a given line of the display panel, the data prepared in the data register being transferred to the display panel to display the given line of the display panel.

The data driver may further comprise a shift register for receiving a latch pulse serving as the control signal as well as a clock signal and providing signals in response to which the data register stores the display data. The data driver may further comprise a latch for holding a line of data provided by the data register and outputting the data in response to the latch pulse. The data driver may further comprise a digital-to-analog converter for converting the output of the latch into analog signals according to reference voltages and supplying the analog signals to the display panel.

The optional data may correspond to a voltage for displaying a specific color. The optional data may correspond to a voltage for displaying black. The optional data may correspond to a minimum voltage among data voltages supplied to the display panel. The optional data may correspond to a voltage nearest to a common voltage applied to a common electrode.

The optional data may be one of first and second optional data that are alternately written into the data register according to an inverting signal. The first and second optional data may correspond to voltages that are symmetrical about a common voltage applied to a common electrode. The first and second optional data may correspond to voltages for displaying a specific color. The first and second optional data may correspond to voltages for displaying black. The display device may be an active-matrix liquid crystal display.

In addition, according to the present invention, there is also provided a method, of driving a display device having a display panel for displaying an image line by line, comprising the steps of writing optional data into a data register in response to a control signal; overwriting the optional data stored in the data register with display data to prepare display data for a given line of the display panel; and transferring the prepared data from the data register to the display panel to display the given line of the display panel.

BRIEF DESCRIPTION OF THE DRAWINGS

The present invention will be more clearly understood from the description of the preferred embodiments as set forth below with reference to the accompanying drawings, wherein.

DESCRIPTION OF THE PREFERRED EMBODIMENTS

For a better understanding of the preferred embodiments of the present invention, a problem in the prior art will be explained with reference to FIGS. 1 to 3.

Figure 1:
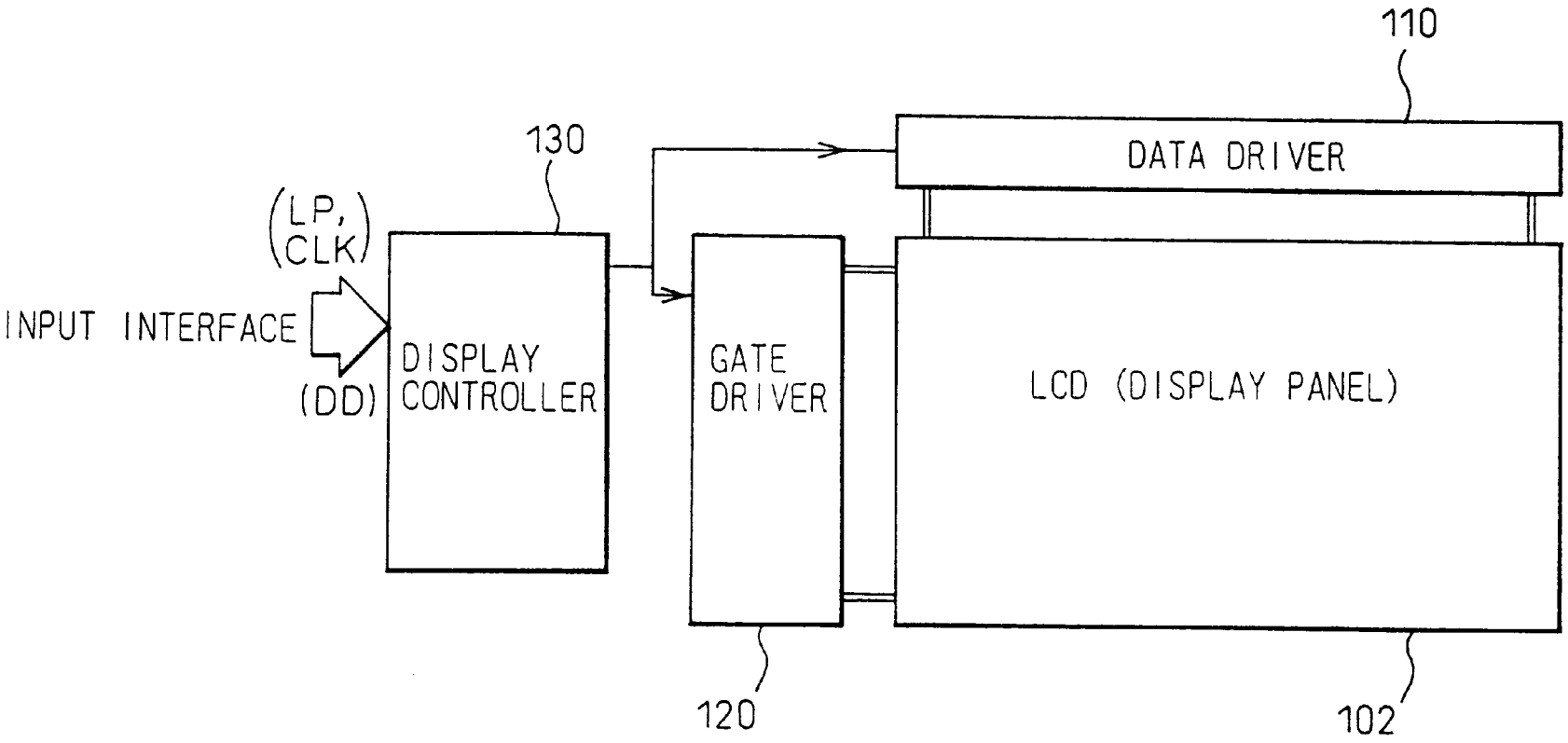
PRIOR ART Fig.1
FIG. 1 shows a conventional liquid crystal display.

FIG. 1 shows a conventional liquid crystal display. The display has a display panel 102, a data driver 110, a gate driver 120, and a display controller 130. The display controller 130 receives display data DD, a latch pulse LP, and a clock signal CLK from an input interface. The data driver 110 stores display data for each line of the panel 102. The gate driver 120 sequentially selects one of the lines of the panel 102, to display an image on the panel 102 according to display data from the data driver 110. The display controller 130 is, for example, a dedicated gate array for converting data from a main device into proper data for each line of the panel 102.

Figure 2:
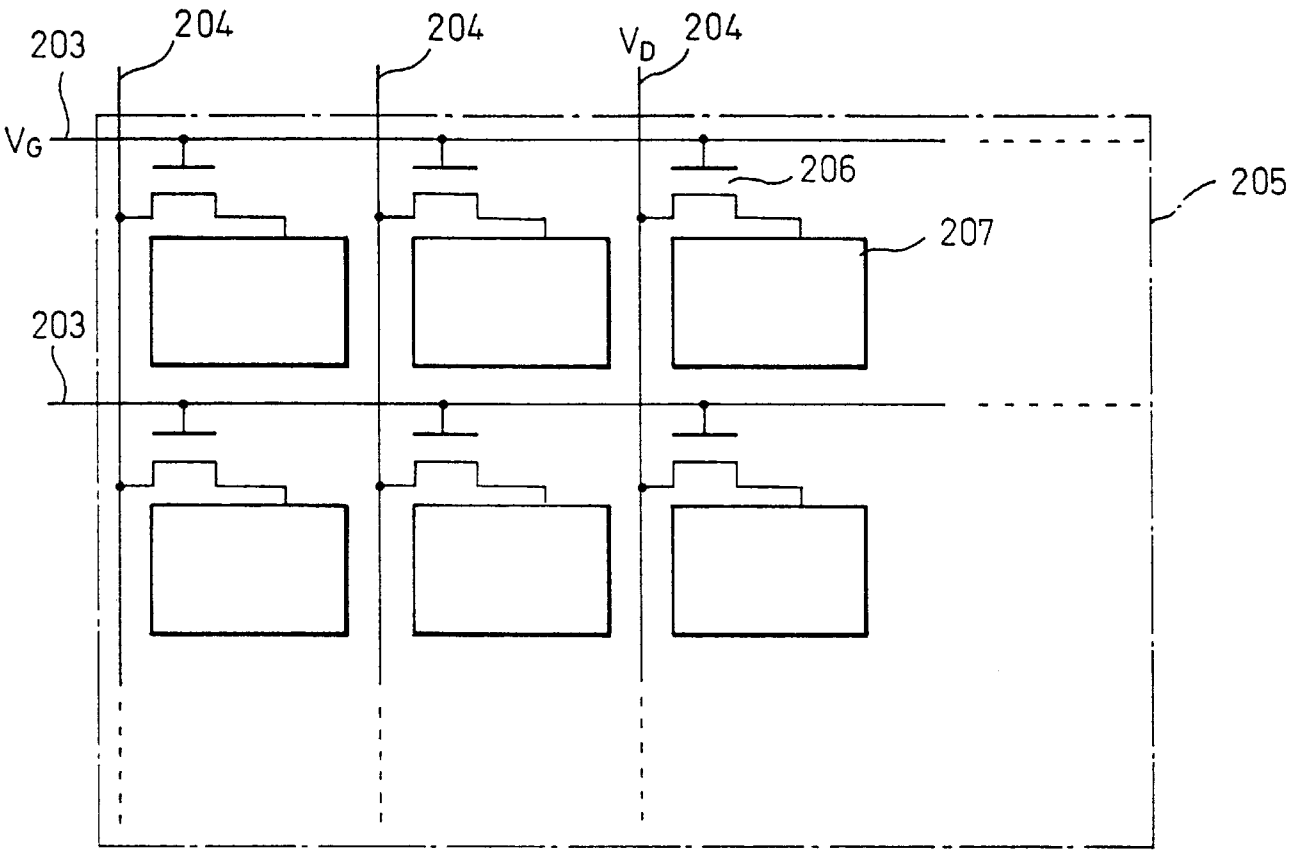
PRIOR ART Fig. 2
FIG. 2 shows a display panel of an active-matrix liquid crystal display.
Figure 3:
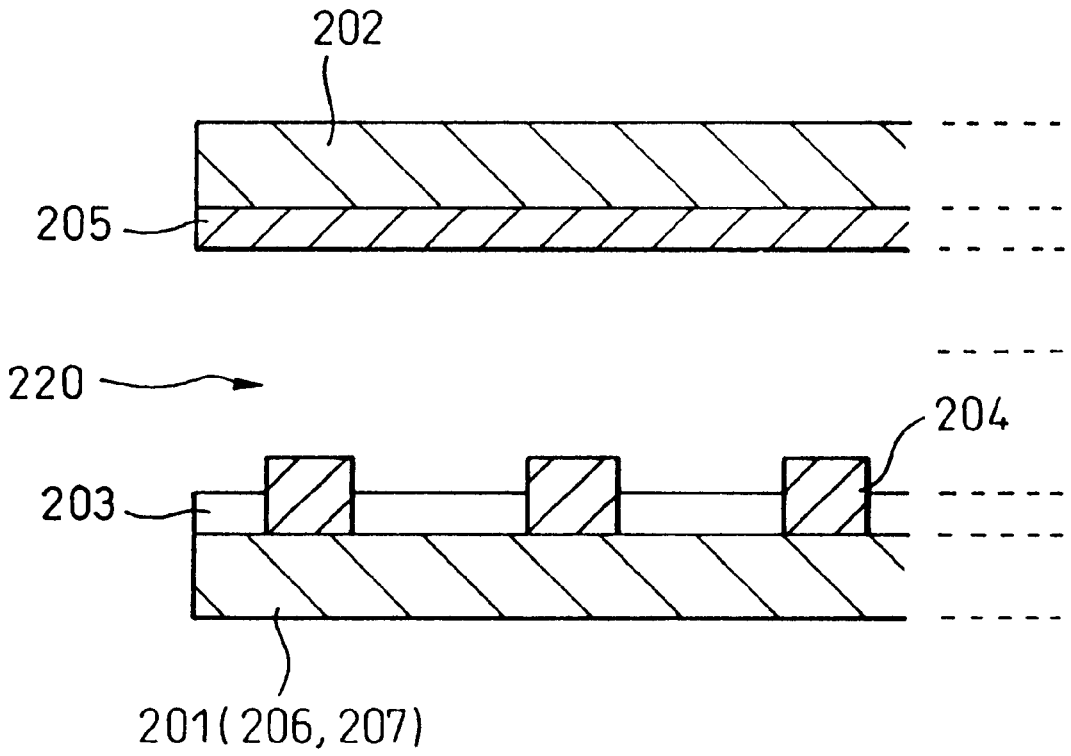
PRIOR ART Fig. 3
FIG. 3 shows a section of the display panel of FIG. 2.

FIG. 2 shows a display panel of an active-matrix liquid crystal display, and FIG. 3 is a section of the same. The panel has a TFT substrate 201, a counter substrate 202, scan lines (gate lines) 203, data lines 204, a common electrode 205, thin film transistors (TFTs) 206, cell electrodes 207, and a liquid crystal layer 220.

The gate and data lines 203 and 204 formed on the TFT substrate 201 intersect each other, and each of the intersections is connected to the TFT 206 that controls the corresponding cell electrode 207. Each cell substrate 207 on the TFT substrate 201 and the common electrode 205 on the counter electrode 202 sandwich the liquid crystal layer 220, to form a liquid crystal cell.

The panel is driven by a dedicated integrated drive circuit. The drive circuit receives display data from a main device such as a personal computer and converts it into data voltages suitable for the panel.

If display data for a CRT is supplied as it is to the liquid crystal display, or if the number of pixels contained in display data does not fit that of the liquid crystal display, the displayed image will be disturbed. For example, the start of each line on the display will be unclear. Accordingly, the conventional display must have the dedicated display controller 130 of FIG. 1 to convert input display data into data suitable for the display.

If the number of pixels in each line on the display is larger than that of input display data, the surplus pixels on the display must display a specific color such as black. This is the reason why the conventional display must have the dedicated display controller 130 to adjust input display data for the capacity of the display.

If there is no such display controller, the improper display data will produce a poor image on the display.

On the other hand, the dedicated display controller increases the number of parts of the drive circuit, needs a large mounting space, consumes power, and deteriorates the versatility of the drive circuit. This problem occurs not only in the liquid crystal displays but also in other displays.

Next, preferred embodiments of the present invention will be explained with reference to the drawings.

Figure 4:
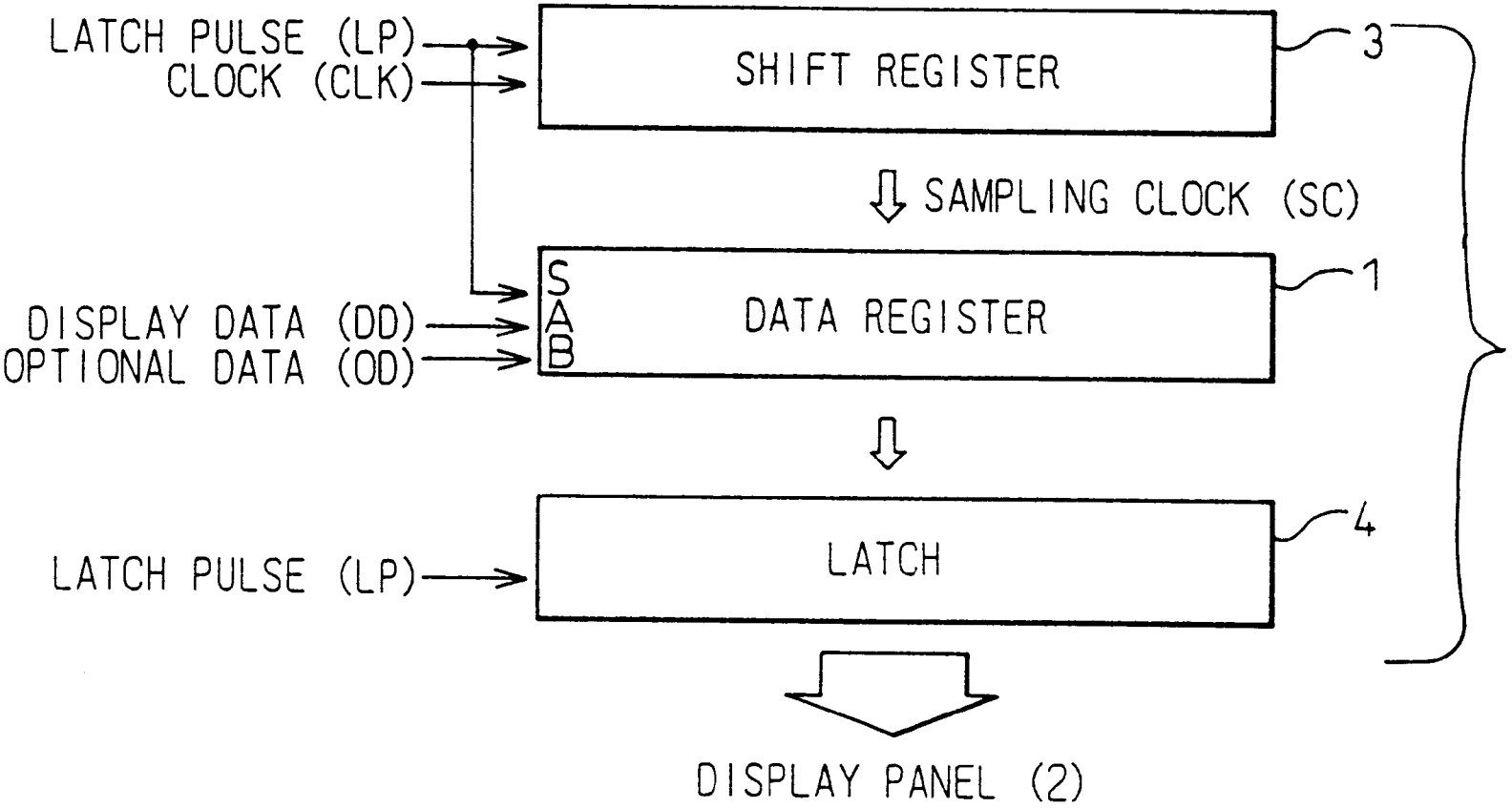
FIG. 4 shows a principle of a drive circuit of a display according to the present invention.

FIG. 4 shows a principle of a drive circuit of a liquid crystal display according to the present invention. The display has a display panel 2 and the drive circuit has a data register 1, a shift register 3, and a latch 4.

The shift register 3 receives a latch pulse LP and a clock signal CLK and provides the data register 1 with sampling clock signals SC used to store data into the data register 1. The latch 4 receives the latch pulse LP and transfers data for one line to the panel 2. The shift register 3 and latch 4 have standard structures.

Figure 6:
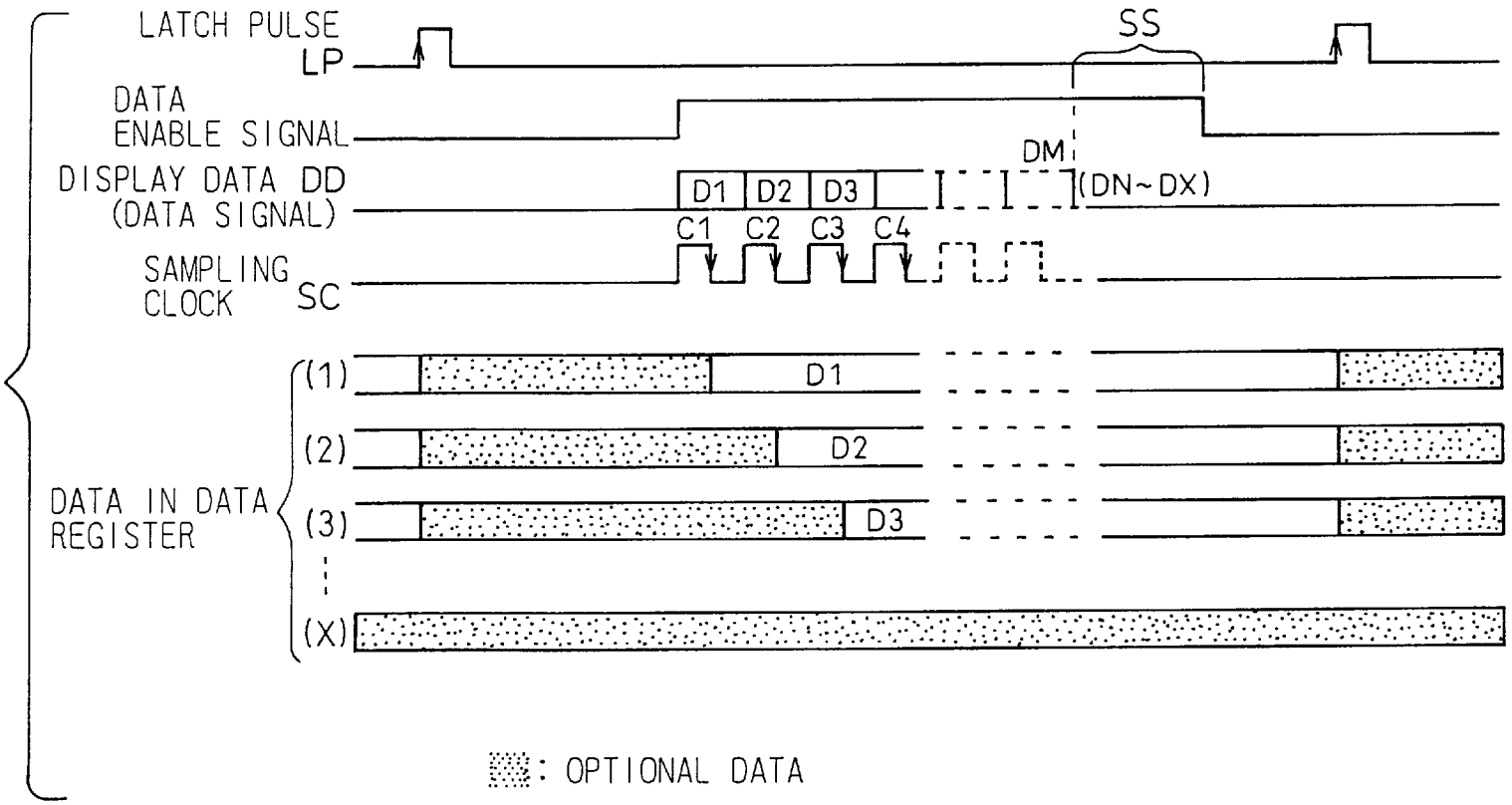
FIG. 6 shows the timing of storing improper display data according to the drive circuit of the present invention.

The data register 1 receives display data DD, optional data OD, and the latch pulse LP. In response to the latch pulse LP, the data register 1 stores the optional data OD. The display data DD is supplied from a main device such as a personal computer and is sometimes insufficient to entirely cover a line of the panel 2 as shown in FIG. 6. The optional data OD corresponds to a voltage for displaying a specific color such as black, white, or blue.

After the data register 1 is filled with the optional data OD, the display data DD is written into the data register 1 in response to the sampling clock signals SC provided by the shift register 3. Namely, the display data DD overwrites the optional data OD. If the display data DD is insufficient to entirely cover a line of the display, the optional data OD will cover a shortage SS (FIG. 6) of display data for the line.

Figure 5:
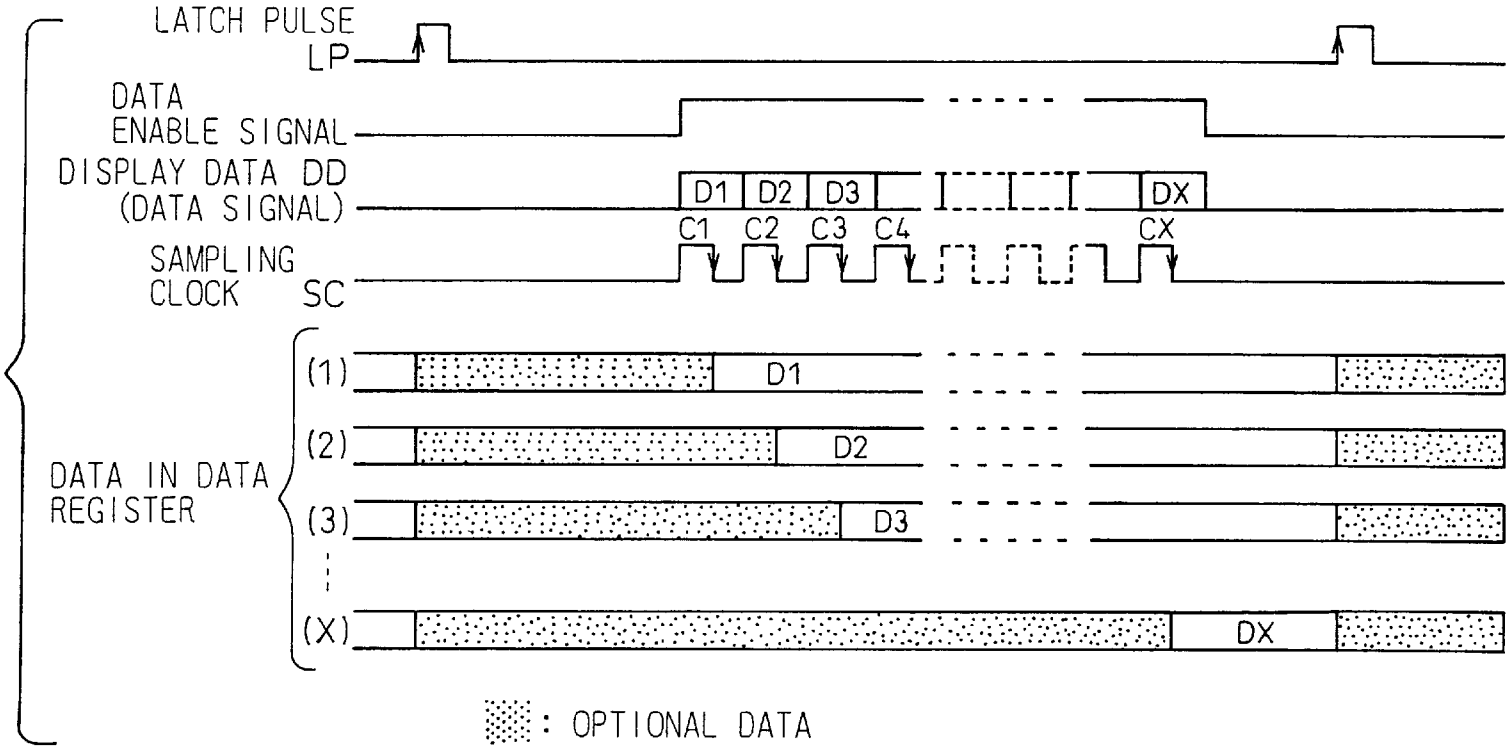
FIG. 5 shows the timing of storing proper display data according to the drive circuit of the present invention.

FIGS. 5 and 6 show the timing of storing data into the drive circuit of the present invention. In FIG. 5, supplied display data fits a line of the panel 2. In FIG. 6, supplied display data is smaller than the capacity of a line of the panel 2.

Referring to FIG. 5, display data DD consists of data signals D1 to DX that fit the capacity of a line of the panel 2. When the latch pulse LP rises, the data register 1 fully stores the optional data OD. When a data enable signal rises, sampling clock pulses C1 to CX are sequentially generated. In response to each fall of the sampling clock pulses, the data register 1 stores the data signals D1 to DX, respectively. Namely, the data signals D1 to DX overwrite the optional data OD in the data register 1.

Referring to FIG. 6, display data DD consists of data signals D1 to DM that are smaller in number than the data signals D1 to DX and are insufficient to entirely fill a line of the panel 2. When the latch pulse LP rises, the data register 1 is filled with the optional data OD. In response to each fall of sampling clock pulses C1 to CX, the data signals D1 to DM are written over the optional data OD in the data register 1. A data shortage area SS corresponding to the data signals DN to DX in the data register 1 keeps the optional data OD as it is. The data in the data register 1 is transferred to the latch 4 in response to the latch pulse LP.

Figure 7:
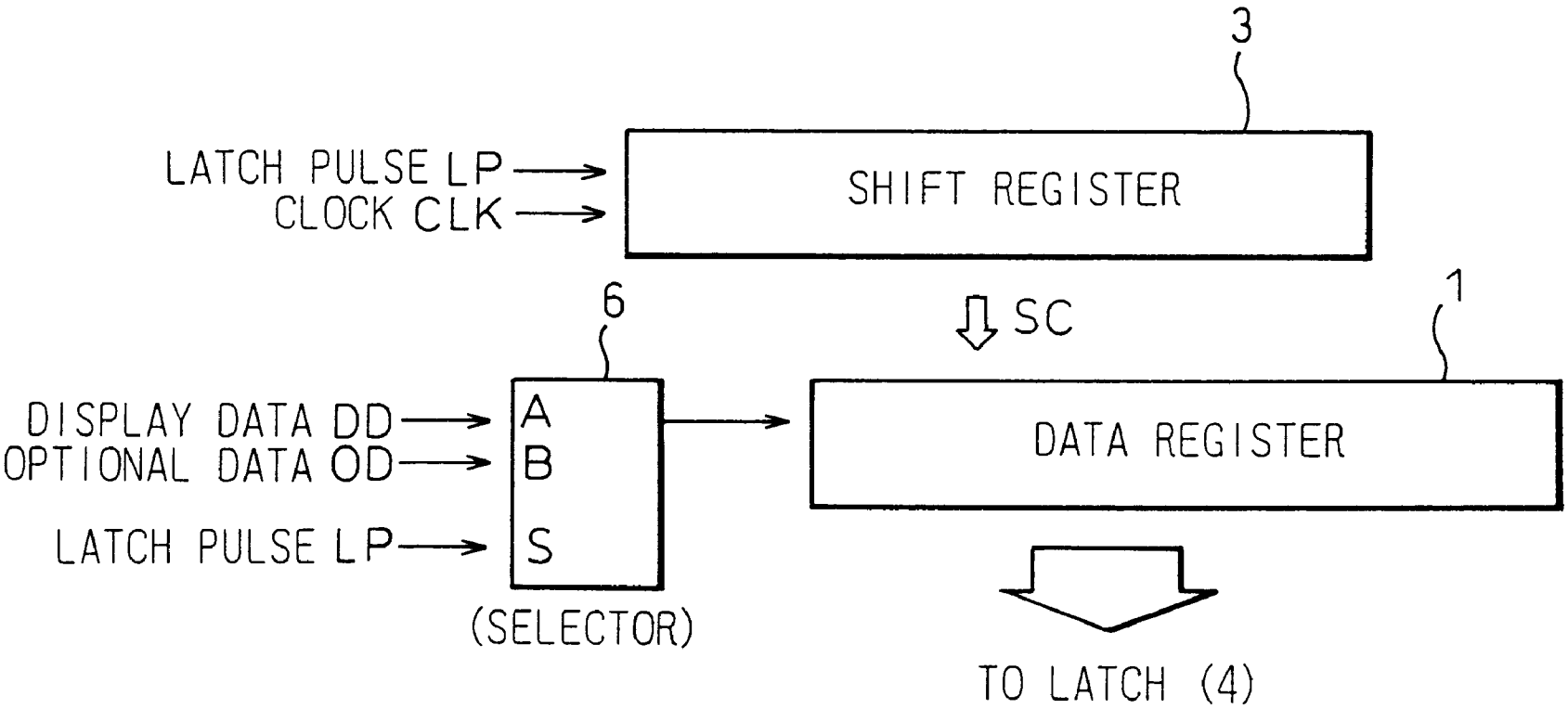
FIG. 7 shows a drive circuit of a display according to an embodiment of the present invention.

FIG. 7 shows a drive circuit according to an embodiment of the present invention. The drive circuit has a selector 6.

Display data DD is supplied to an input terminal A of the selector 6, optional data OD is supplied to an input terminal B of the same, and a latch pulse LP is supplied to a select terminal S of the same. According to the latch pulse LP, the selector 6 selects one of the display data DD and optional data OD. When the latch pulse LP rises to high level, the selector 6 selects the optional data OD and supplies it to a data register 1, which fully stores the optional data OD. After the latch pulse LP falls to low level, the selector 6 selects the display data DD and supplies it to the data register 1, which sequentially stores the display data DD.

When the latch pulse LP rises, data stored in the data register 1 is transferred to a latch 4. At this time, the selector 6 selects the optional data OD and supplies it to the data register 1. Consequently, the data register 1 is filled with the optional data OD.

Figure 8:
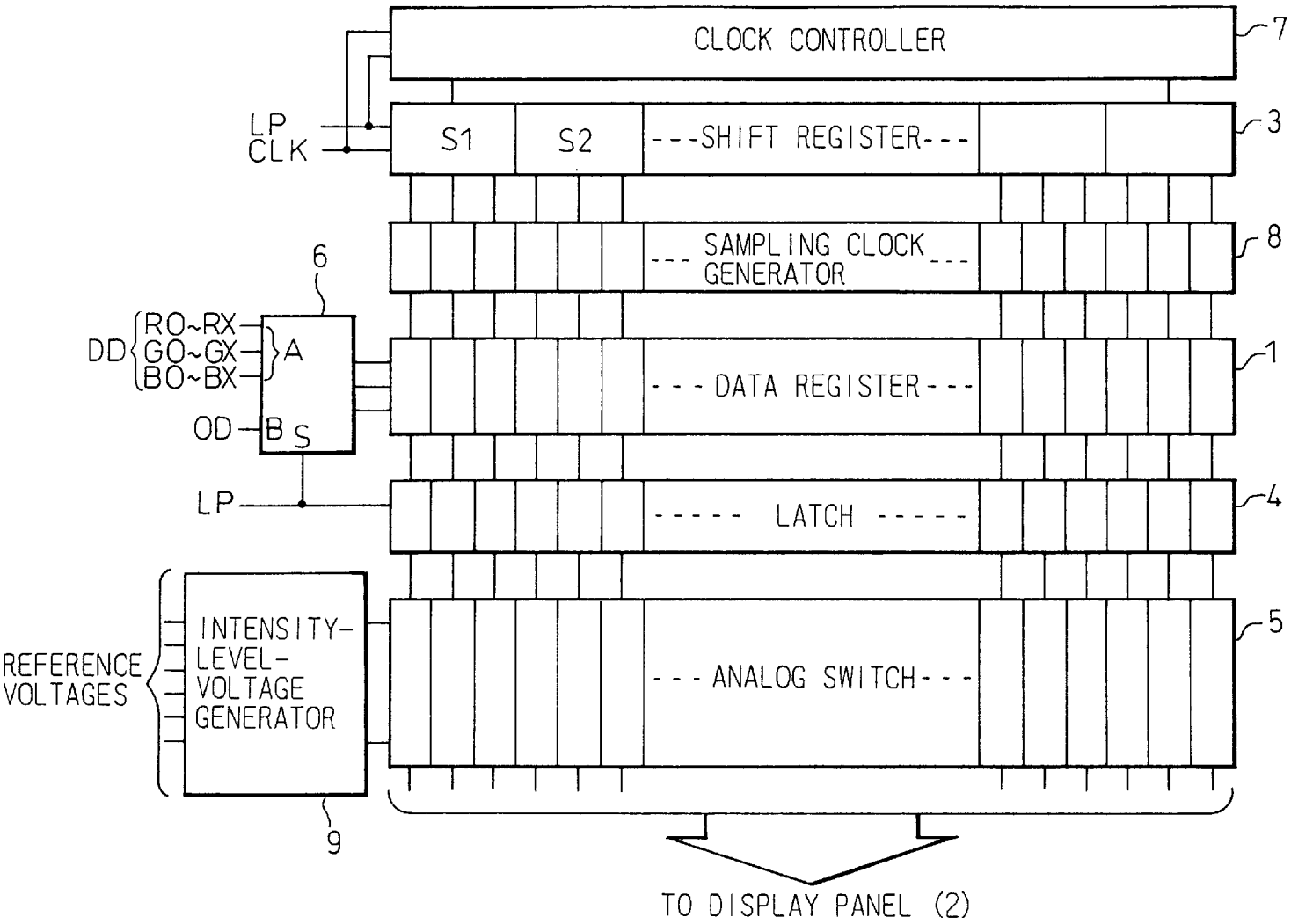
FIG. 8 shows an example of the structure of the drive circuit of FIG. 7.

FIG. 8 shows an example of the drive circuit of FIG. 7. The drive circuit has a clock controller 7, a sampling clock generator 8, and an intensity-level-voltage generator 9. The drive circuit of FIG. 8 is used to drive a liquid crystal display capable of displaying color images with red (R), green (G), and blue (B) primary colors.

When a latch pulse LP rises to high level, the clock controller 7 provides clock signals to the shift register 3, which lets the sampling clock generator 8 provide sampling clock signals. Then, the data register 1 becomes ready to store data. In response to the latch pulse LP to the select terminal S, the selector 6 selects optional data OD and supplies the same to the data register 1. In response to sampling clock signals SC from the sampling clock generator 8, display data DD consisting of signals R0 to RX, G0 to GX, and B0 to BX overwrites the optional signal OD in the data register 1. The data register 1 transfers the stored data to the latch 4 in response to the next latch pulse LP. This embodiment simultaneously stores each one of the red (R), green (G), and blue (B) signals R0 to RX, G0 to GX, and B0 to BX of the display data DD into the data register 1 in response to each sampling clock signal.

If the display data DD is insufficient to fill a line of the panel 2 as shown in FIG. 6, the optional data OD is transferred as it is for the insufficient part of the line from the data register 1 to the latch 4. The data in the latch 4 is transferred to the panel 2 through a digital-to-analog converter 5, to fully display the line of the panel 2. The optional data OD may fill the insufficient part of a line with a color of, for example, black, white, or blue.

The latch pulse LP is commonly supplied to the shift register 3, clock controller 7, data register 1, and latch 4. When the latch pulse LP rises, data stored in the data register 1 is transferred to the latch 4. Thereafter, sampling clock signals SC are applied to the data register 1, which starts to store the optional data OD. Although this embodiment drives these components according to the same latch pulse, there will be no interference among the operations of them because there is a delay between transferring data from the data register 1 to the latch 4 and storing the optional data OD for the next display line into the data register 1.

Figure 9:
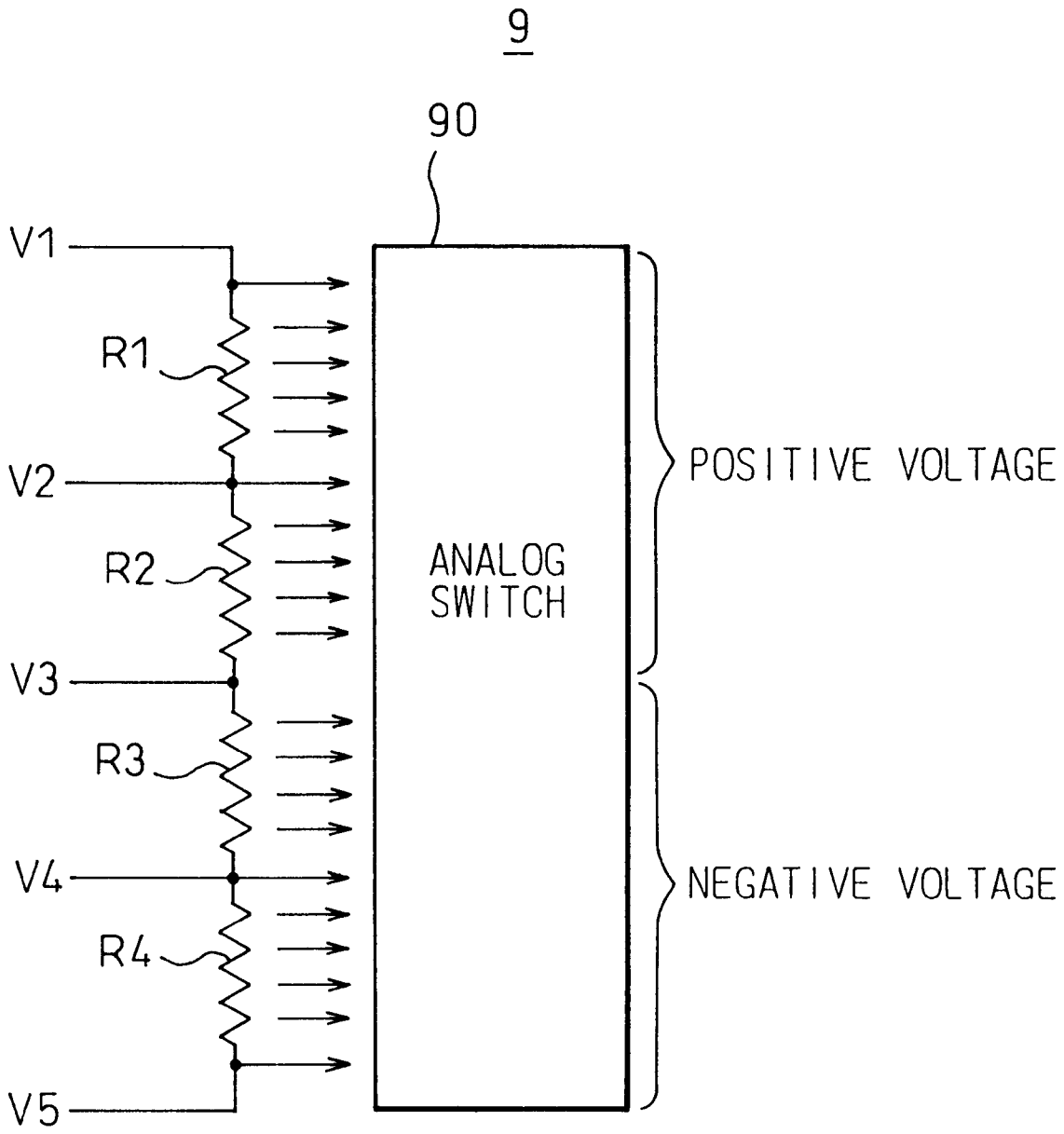
FIG. 9 shows an intensity-level-voltage generator of the drive circuit of FIG. 8.

FIG. 9 shows an example of the intensity-level-voltage generator 9 of FIG. 8.

The generator 9 has resistors R1 to R4 and an analog switch 90. The resistors R1 to R4 divide reference voltages V1 to V5 into output voltages, and the required voltages are selected by the switch 90. In FIG. 9, the switch 90 provides positive and negative voltages.

Figure 10:
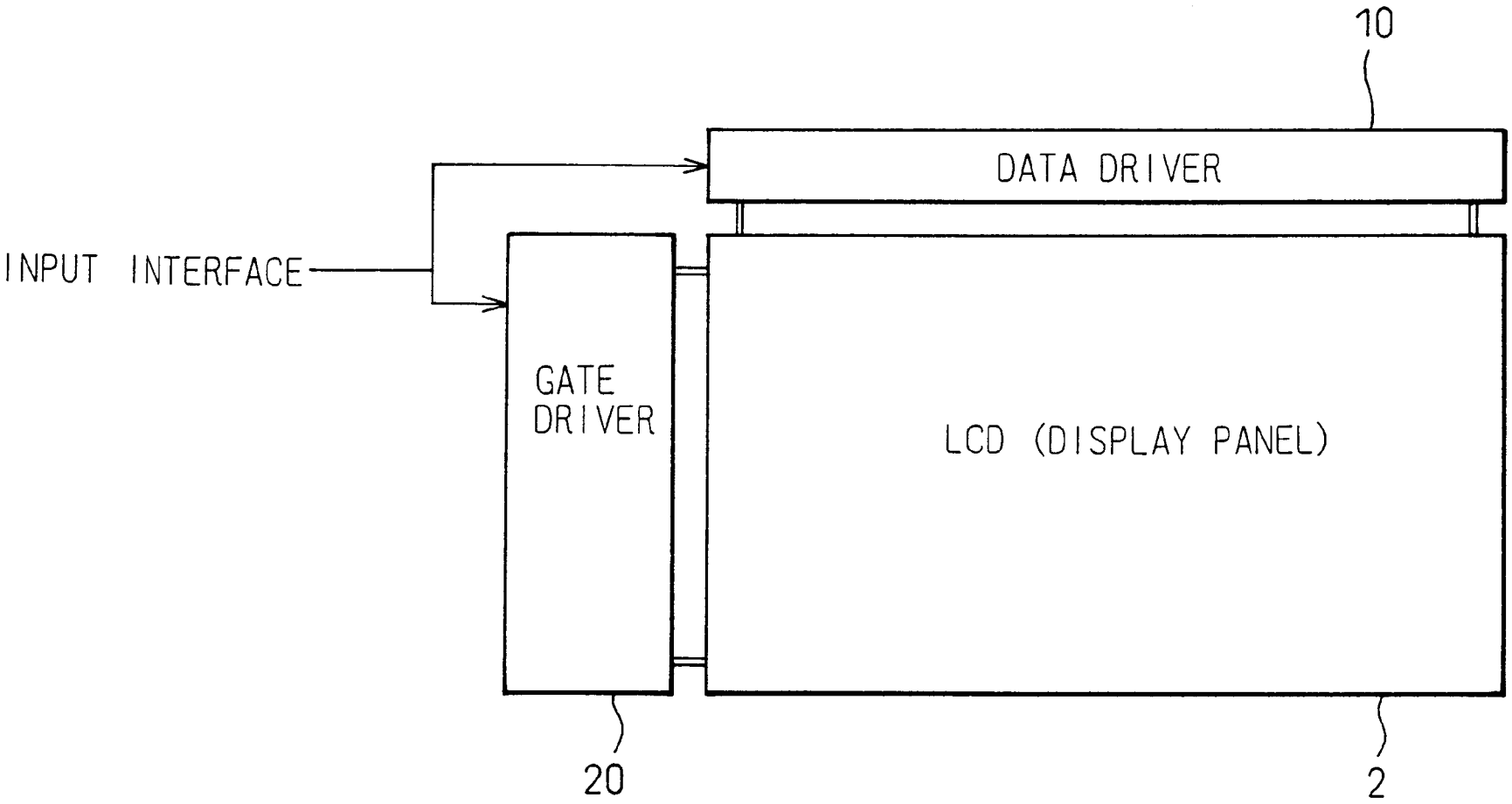
FIG. 10 shows a liquid crystal display employing the drive circuit of the present invention.

FIG. 10 shows a liquid crystal display employing the drive circuit of the present invention.

Display data from an input interface is directly supplied to a data driver 10 without passing the display controller 130 of FIG. 1. The drive circuit of FIG. 8 may be incorporated in the data driver 10.

Even if the display data is improper for the display, the drive circuit supplements the display data without the dedicated display controller. This results in reducing the mounting space and power consumption of the drive circuit and securing the versatility of the drive circuit.

Figure 11:
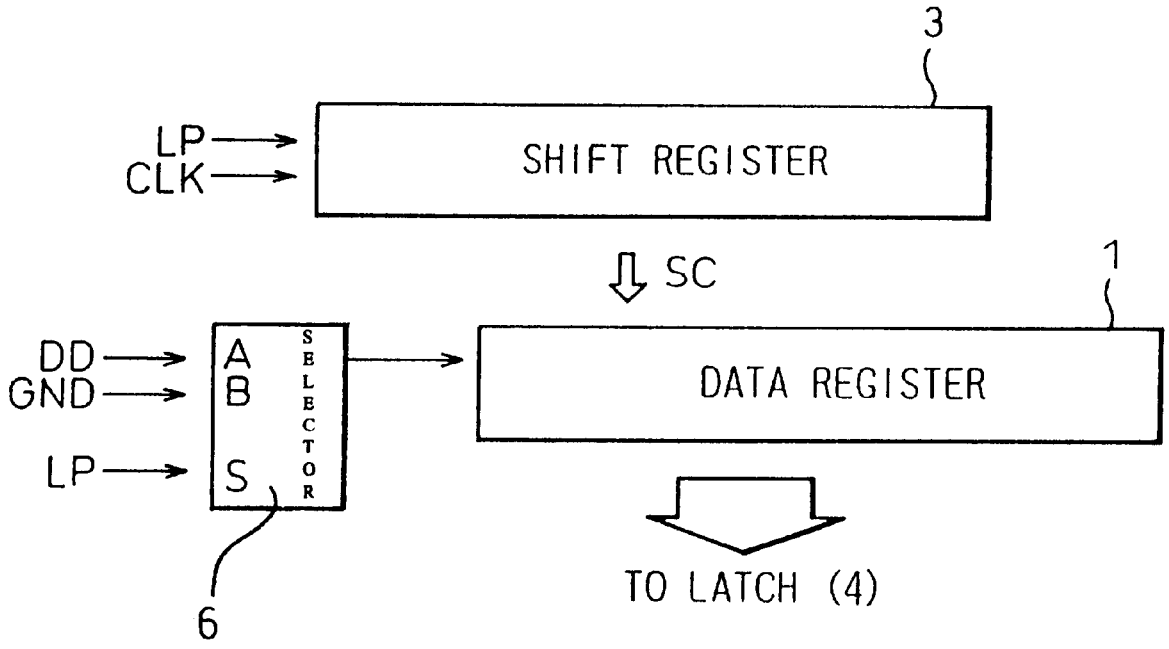
FIG. 11 shows an example of optional data handled by the drive circuit of FIG. 7.

FIG. 11 shows an example of the optional data OD handled by the drive circuit of FIG. 7. The optional data OD supplied to the input terminal B of the selector 6 may be equal to a minimum voltage GND among output voltages provided by the selector 6 and may correspond to black. The optional data OD may be a voltage nearest to a common voltage applied to the common electrode 205 (FIG. 2). The optional data OD, however, is not limited to the minimum voltage GND or the common voltage.

Figure 12:
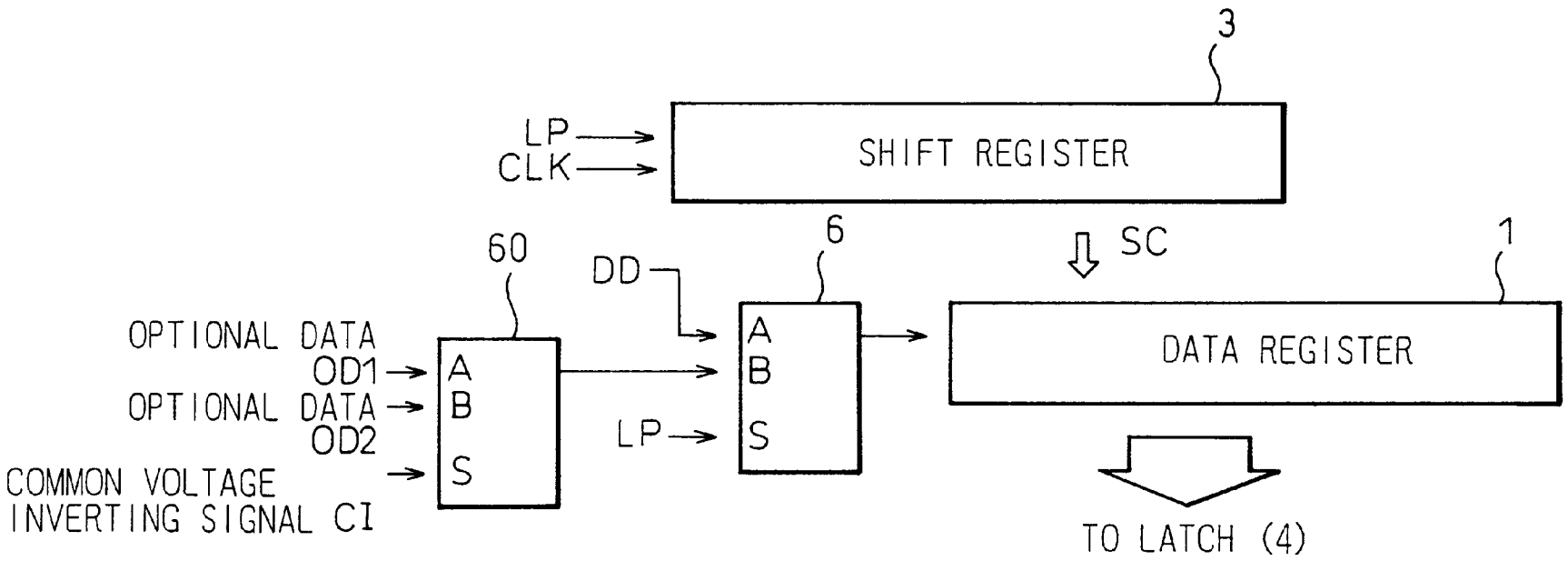
FIG. 12 shows a drive circuit of a display according to another embodiment of the present invention.

FIG. 12 shows a drive circuit of a display according to another embodiment of the present invention. This embodiment prepares two kinds of optional data OD1 and OD2 that are alternately selected according to a common voltage inverting signal CI, and the selected one is supplied to an input terminal B of a selector 6. This drive circuit is applicable to the active-matrix liquid crystal display of FIGS. 2 and 3.

A selected one of the optional data OD1 and OD2 is written into a data register 1 in response to a latch pulse LP, in synchronization with the AC driving of the display.

Figure 13:
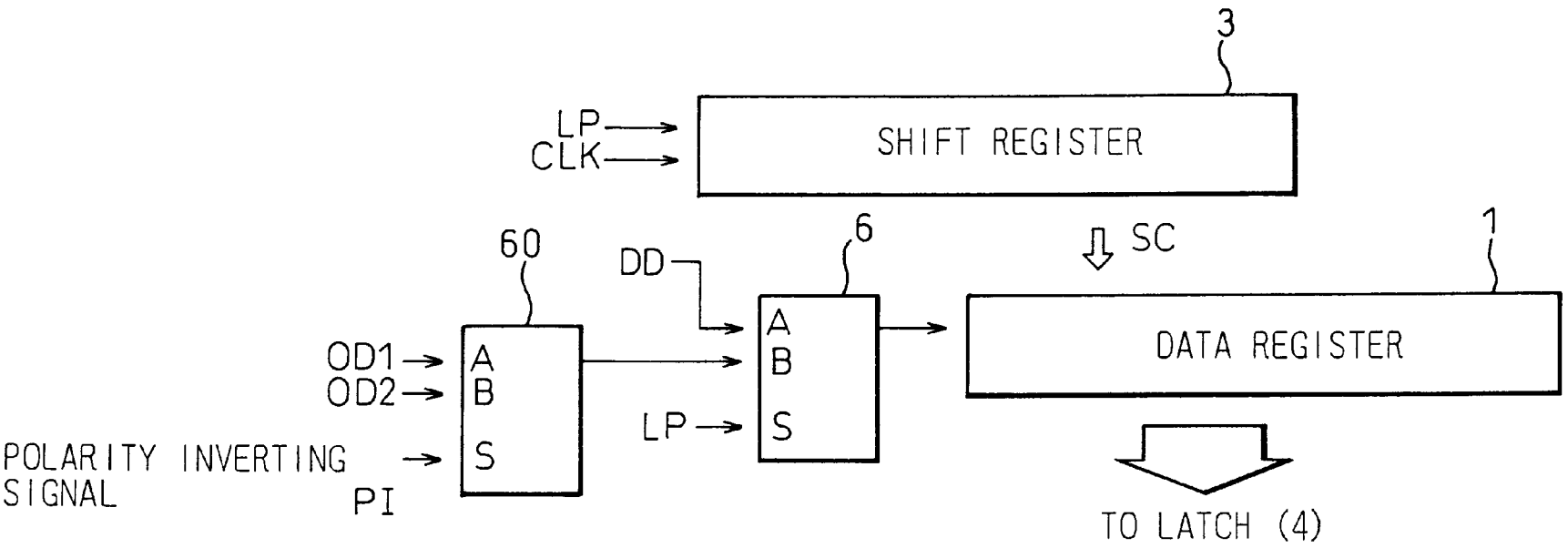
FIG. 13 shows a modification of the drive circuit of FIG. 12.

FIG. 13 is a modification of the embodiment of FIG. 12. A selector 60 selects one of optional data OD1 and OD2 according to a polarity inverting signal PI. The other parts of FIG. 13 are the same as those of FIG. 12.

Figure 14:
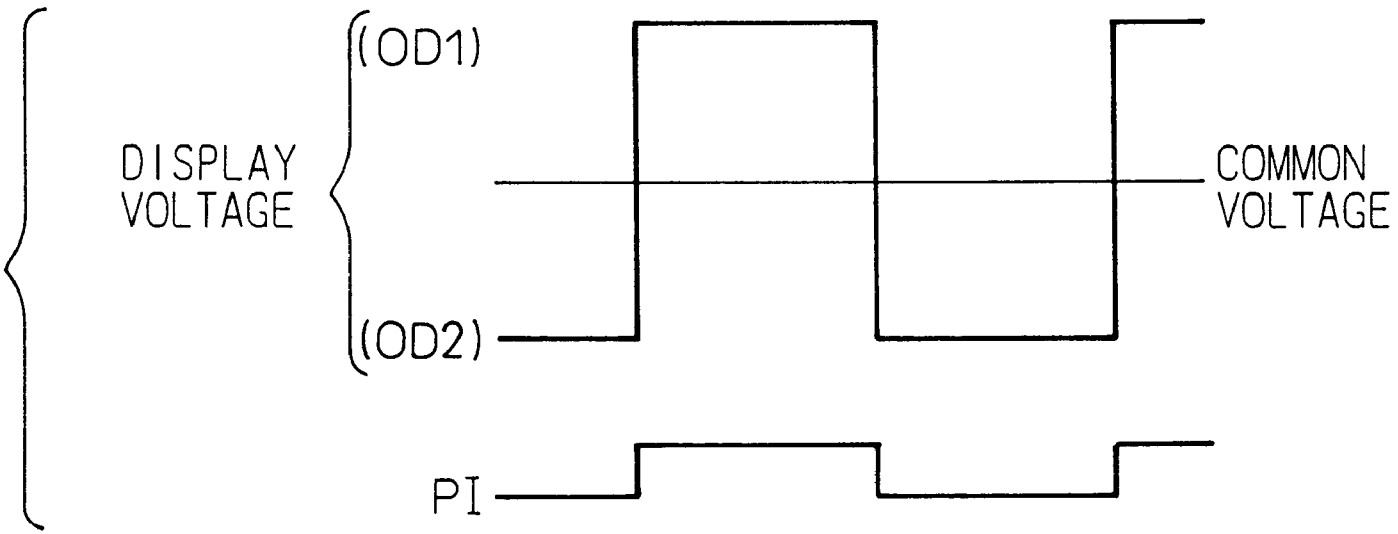
FIG. 14 shows signal waveforms in the drive circuit of FIG. 13.

FIG. 14 shows signal waveforms in the drive circuit of FIG. 13. When the signal PI is at high level, the selector 60 selects the optional data OD1 supplied to an input terminal A thereof, and when the signal PI is at low level, the selector 60 selects the optional data OD2 supplied to an input terminal B thereof. The optional data OD1 and OD2 have opposite polarities and are symmetrical about a common voltage applied to the common electrode 205 (FIG. 2). The optional data OD1 and OD2 are alternately written into the data register 1 in response to the signal PI.

The active-matrix liquid crystal display of each of the above embodiments inverts a common voltage. If the common voltage is fixed, there is no need to employ two kinds of optional data OD1 and OD2. If the common voltage is fixed, optional data will be at the voltage nearest to the common voltage. A timing signal used to write the optional data OD (OD1, OD2) into the data register 1 is not limited to the latch pulse LP.

As explained above, the present invention provides a drive circuit of a liquid crystal display, capable of supplementing display data if the display data is improper for the display, thereby securing the quality of displayed images and the sound operation of liquid crystals. Since the drive circuit of the present invention has no need of data conversion, the drive circuit is not provided with a dedicated display controller such as a gate array. As a result, the drive circuit of the present invention decreases the mounting space required, and the power consumption, and secures the versatility thereof. Many different embodiments of the present invention may be constructed without departing from the spirit and scope of the present invention, and it should be understood that the present invention is not limited to the specific embodiments described in this specification, except as defined in the appended claims.

What is claimed is:

1. A drive circuit of a liquid crystal display device having a liquid crystal display panel for displaying an image line by line, comprising:

a data register for storing optional data in response to a control signal, the optional data being data for filling display data when the number of pixels of the display panel is larger than that of the display data, overwriting the stored optional data with the display data to prepare display data for a given line of the display panel, the data prepared in the data register being transferred to the display panel to display the given line of the display panel.

2. A drive circuit as claimed in claim 1, wherein the drive circuit further comprises a shift register for receiving a latch pulse serving as the control signal as well as a clock signal and providing signals in response to which the data register stores the display data.

3. A drive circuit as claimed in claim 1, wherein the drive circuit further comprises a latch for holding a line of data provided by the data register and outputting the data in response to the latch pulse.

4. A drive circuit as claimed in claim 3, wherein the drive circuit further comprises a digital-to-analog converter for converting the output of the latch into analog signals according to reference voltages and supplying the analog signals to the display panel.

5. A drive circuit as claimed in claim 1, wherein the optional data corresponds to a voltage for displaying a specific color.

6. A drive circuit as claimed in claim 5, wherein the optional data corresponds to a voltage for displaying black.

7. A drive circuit as claimed in claim 5, wherein the optional data corresponds to a minimum voltage among data voltages supplied to the display panel.

8. A drive circuit as claimed in claim 5, wherein the optional data corresponds to a voltage nearest to a common voltage applied to a common electrode.

9. A drive circuit as claimed in claim 5, wherein the optional data is one of first and second optional data that are alternately written into the data register according to an inverting signal.

10. A drive circuit as claimed in claim 9, wherein the first and second optional data correspond to voltages that are symmetrical about a common voltage applied to a common electrode.

11. A drive circuit as claimed in claim 9, wherein the first and second optional data correspond to voltages for displaying a specific color.

12. A drive circuit as claimed in claim 9, wherein the first and second optional data correspond to voltages for displaying black.

13. A liquid crystal display device having a liquid crystal display panel for displaying an image line by line, a data driver for storing display data for each line of the display panel, and a gate driver for sequentially selecting one of the lines of the display panel, wherein the data driver comprises:

a data register for storing optional data in response to a control signal, the optional data being data for filling display data when the number of pixels of the display panel is larger than that of the display data, overwriting the stored optional data with the display data to prepare display data for a given line of the display panel, the data prepared in the data register being transferred to the display panel to display the given line of the display panel.

14. A display device as claimed in claim 13, wherein the data driver further comprises a shift register for receiving a latch pulse serving as the control signal as well as a clock signal and providing signals in response to which the data register stores the display data.

15. A display device as claimed in claim 13, wherein the data driver further comprises a latch for holding a line of data provided by the data register and outputting the data in response to the latch pulse.

16. A display device as claimed in claim 15, wherein the data driver further comprises a digital-to-analog converter for converting the output of the latch into analog signals according to reference voltages and supplying the analog signals to the display panel.

17. A display device as claimed in claim 13, wherein the optional data corresponds to a voltage for displaying a specific color.

18. A display device as claimed in claim 17, wherein the optional data corresponds to a voltage for displaying black.

19. A display device as claimed in claim 17, wherein the optional data corresponds to a minimum voltage among data voltages supplied to the display panel.

20. A display device as claimed in claim 17, wherein the optional data corresponds to a voltage nearest to a common voltage applied to a common electrode.

21. A display device as claimed in claim 17, wherein the optional data is one of first and second optional data that are alternately written into the data register according to an inverting signal.

22. A display device as claimed in claim 21, wherein the first and second optional data correspond to voltages that are symmetrical about a common voltage applied to a common electrode.

23. A display device as claimed in claim 21, wherein the first and second optional data correspond to voltages for displaying a specific color.

24. A display device as claimed in claim 21, wherein the first and second optional data correspond to voltages for displaying black.

25. A method of driving a liquid crystal display device having a liquid crystal display panel for displaying an image line by line, comprising the steps of:

writing optional data into a data register in response to a control signal, the optional data being data for filling display data when the number of pixels of the display panel is larger than that of the display data;

overwriting the optional data stored in the data register with the display data to prepare display data for a given line of the display panel; and transferring the prepared data from the data register to the display panel to display the given line of the display panel.

* * * * *